United States Patent [19]

Büttner, deceased

[11] 4,153,271

[45] May 8, 1979

[54] BINDING FOR CROSS-COUNTRY SKIING

[75] Inventor: Franz Büttner, deceased, late of Egg, Switzerland, by Raoul Imseng and Urs Widmer, as agents for Allgemeine Treuhand AG, Zurich, Switzerland, legal representatives

[73] Assignee: Kästle (Schweiz) AG, Heerbrugg, Switzerland

[21] Appl. No.: 759,246

[22] Filed: Jan. 13, 1977

[30] Foreign Application Priority Data

Jan. 16, 1976 [CH] Switzerland ..... 484/76

[51] Int. Cl.[2] ..... A63C 9/20

[52] U.S. Cl. ..... 280/615

[58] Field of Search ..... 280/615, 614; 24/250, 24/258, 68 SK, 68 T, 69 SK, 70 SK

[56] References Cited

U.S. PATENT DOCUMENTS

| | | | |
|---|---|---|---|
| 3,877,712 | 4/1975 | Weckeiser | 280/614 |
| 3,907,319 | 9/1975 | Berlied, Jr. | 280/615 |
| 3,920,257 | 11/1975 | Fredriksen | 280/615 |
| 3,945,657 | 3/1976 | Fredriksen | 280/615 |

FOREIGN PATENT DOCUMENTS

| | | | |
|---|---|---|---|
| 993234 | 10/1951 | France | 280/615 |
| 2290925 | 6/1976 | France | 280/615 |
| 64695 | 4/1942 | Norway | 280/615 |
| 71998 | 4/1947 | Norway | 280/614 |
| 108122 | 8/1943 | Switzerland | 280/615 |

*Primary Examiner*—David M. Mitchell

*Attorney, Agent, or Firm*—Birch, Stewart, Kolasch & Birch

[57] ABSTRACT

The present invention is directed to a binding for cross-country skiing. The binding includes a lever which is pivotally mounted about an axis positioned in a plane above the bail. The lever is provided with a cam which protrudes downwardly and exerts a pressure on the bail at a predetermined distance from the pivoting axis.

13 Claims, 3 Drawing Figures

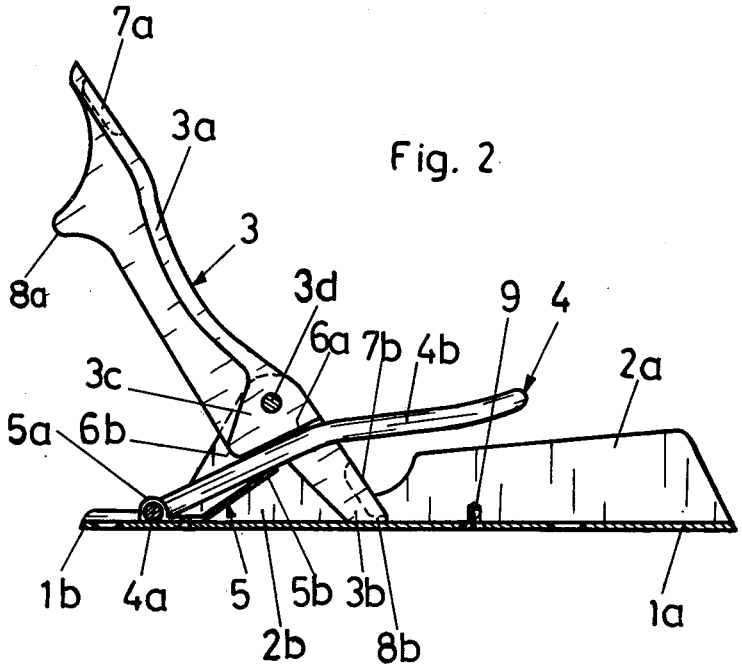
Fig. 2
Fig. 3
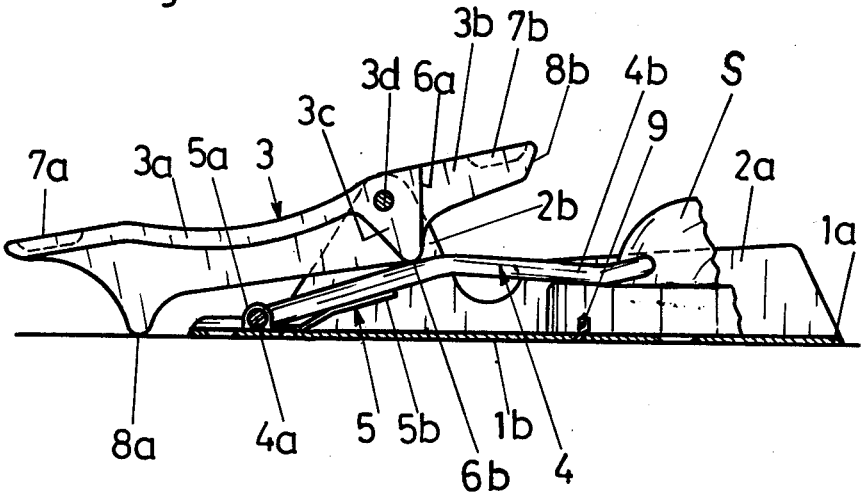

BINDING FOR CROSS-COUNTRY SKIING

FIELD OF THE INVENTION

The invention relates to a binding for cross-country skiing.

DESCRIPTION OF THE PRIOR ART

On the conventional bindings for cross-country skiing most frequently used the lip (clamping bail) with its free outwardly extending end portions is pivoted in hollow rivets on the vertical sides of the base plate. In addition, a projecting front portion, linking the two side portions of the bail, may be engaged in a keeping hook which usually includes several teeth and is pivotally anchored to the ski by means of the base plate. The locking of the boot is effected by pressing down the clamping bail by hand until it engages a tooth of the keeping hook whereby the portions of the bail between the pivoting point and the front portion are pressed against the edge of the boot-sole. In order to release these known prior art bindings the bail must be depressed to disengage. Therefore a relatively high amount of force is necessary to lock and release this binding and can only be carried out with difficulty by the skier who is still fixed to the binding. Furthermore, the projecting arms placed on the inner side of the base plate make it more difficult to insert the boot correctly into the binding and to remove it from the base plate after releasing the pressure of the bail. An easier handling can be achieved with a different kind of binding for cross-country skiing, i.e. with a binding for cross-country skiing consisting of a base plate with side plates, including a pivotally mounted bail at a certain distance from the boot which has the function to lock the boot-toe temporarily to the base plate. Furthermore, the binding includes a lever which co-operates with the bail so that after pivoting the bail upwards into a first position the binding is released and after passing a dead center a second position of the lever is reached which pushes down the bail and thus locks the binding. The present invention also relates to this kind of bindings for cross-country skiing.

A binding of the above discussed type is described, for example, in U.S. Pat. No. 3,907,319. This binding for cross-country skiing does not, however, represent a satisfying solution for the bearing of the lever and the co-operation of the lever and the bail to lock down the boot.

However, due to the fact that on the ski binding according to U.S. Pat. No. 3,907,319 the lever is pivotally connected with the base plate by means of rollers there can easily be faults in the functioning of the binding, particularly if ice or snow are on the base plate. Moreover, the rollers increase the cost of production. Furthermore, this ski binding can only be opened with difficulty as the lever in its closed position cannot be properly handled. There is no possibility as to release or lock the ski binding by means of the ski-pole. Therefore it is the object of the present invention to eliminate the above-mentioned disadvantages of the prior art bindings for cross-country skiing and to provide a binding for cross-country skiing which can easily be handled with a minimum amount of force and without troubles.

DESCRIPTION OF THE INVENTION

According to the present invention this can be achieved by positioning the lever pivotally about an axis lying above the bail and by providing the lever with a cam protruding downwardly which exerts its pressure on the bail at a certain distance from its pivoting axis.

It is suitable if the cam extends downwardly from the area of the pivoting axis of the lever and if the pivoting axis of the lever is positioned approximately above the middle of the bail between its front pivoting axis and its rear free end which presses on the edge of the boot-sole.

The cam which enables the downward-pressing of the preferably arm-shaped bail does not press on the bail immediately at its pivoting point but at a distance. The relatively small height of the cam makes the necessary pivoting motion between the release and locking position of the bail possible and it is of advantage that the length of the lever which can actually be freely chosen amounts to a multiple of the cam height a leverage between the lever and the locking portion of the bail which makes it possible to keep the force necessary to close or release the binding with the lever practically at a desired small amount. It is of advantage to provide the end of the lever handle with a recess which makes the pressing down of the lever possible in order to lock the binding with the top of the pole thereby the frustrating stooping down becomes unnecessary.

It is of particular advantage if the lever has an extension beyond the cam or in other words is a two-arm lever. In this case the cam can be operated by pressure, e.g. by pressing down the pole on the extension arm (release arm), in order to release the binding by getting over its dead center. It has also proven to be of advantage to provide the bail with a pressure-exerting spring, e.g. a leaf spring, fixed to the base plate in order to release the binding. The unwanted releasing of the binding by the spring is prevented by the cam in a position beyond the dead center. Instead of a spring that pushes the bail upwards when the binding is released the cam could also be provided with a carrier bolt protruding under the bail. Because the bail is not pivoted in the side plates it cannot hinder the inserting or removing of the boot from the binding. In order to fix the boot to the base plate not only frictionally by clamping but also by positive locking the base plate can be provided with pins protruding into the boot-sole or for example with a pin engaging into a transversal slot on the bottom side of the sole.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2 is a vertical longitudinal section of the binding according to FIG. 1 in the released position; and FIG. 3 is a section analogous to FIG. 2 with the binding in the locked position.

DESCRIPTION OF THE PREFERRED EMBODIMENTS

Figure 1:
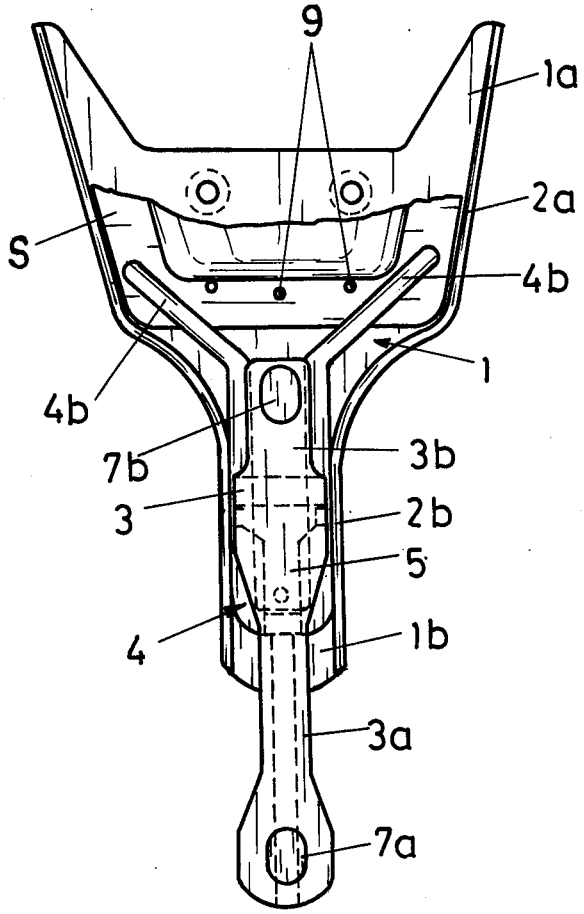
FIG. 1 is a plan view of a binding for cross-country skiing in the locked position.

The binding for cross-country skiing has a base plate 1 screwed to the upper horizontal surface of the ski in the usual way. The base plate 1 has a toepiece 1*a* and includes a bearing part 1*b* of smaller width which extends forward thereof. The side parts 2*a* of the toepiece 1*a* which are bent inwards at their tops are extended with respect to the bearing part 1*b* forming therewith two bearing brackets 2*b*. A lever 3 is pivotally mounted in the brackets 2*b* at a distance above the bearing part 1*b* which includes a mainly forward extending locking arm 3*a*, a mainly rearward extending release arm 3*b* and a cam 3*c* extending downward from the bearing 3*d*. In front of the bearing 3*d* of the lever 3 is a bail 4 which is pivotally mounted immediately on the bearing part 1*b*. This is achieved by the clamp-like end portion 5*a* of a leaf spring 5 which is riveted to the bearing part 1*b* and overlaps the bail arm 4*a* of the bail 4. The spring tongue 5*b* which is broadened at the free end extends towards the toepiece 1*a*. It is bent towards the top and presses from the bottom against the bail arms 4*b* of the bail 4. The bail 4 extends rearward over the toepiece 1*a* first running parallel to each other below the cam 3*c* and then strutted against the side parts 2*a*. The cam 3*c* has a stopping plane 6*a* on the side turned towards the release arm 3*b* which changes over into a semi-cylindrical pressure area 6*b* where the cam reaches its greatest height (FIG. 2,3). The free end portions of the locking arms 3*a* as well as those of the shorter release arms 3*b* have a recess 7*a* and 7*b*, respectively on their upper sides and a supporting area 8*a* and 8*b*, respectively on their lower sides.

The handling of the above-mentioned binding can thus be described as follows:

Supposing the binding is in the open position according to FIG. 2 where the lever 3 is moved upwards so far that the supporting area 8*b* touches the base plate 1; in this position of the lever 3 and the cam 3*c* the bail arms 4*b* of the bail 4 are pushed upwards by the spring 5 and touch the stopping plane 6*a* of the cam 3*c* which means that the spread-apart free end portions of the bail arms 4*b* are relatively high above the toepiece 1*a* of the base plate 1. In this open position of the binding the boot (as indicated in FIGS. 1 and 3 by the letter S) can be inserted in its proper position between the side parts 2*a* of the toepiece 1*a* of the base plate without any difficulties. The boot S will be held by the pins 9 that are provided in the conventional manner to hold the sole and prevent it from gliding. Now the skier can push forward the locking arm 3*a* round, which pivots around bearing 3*d*, either by hand or with the point of his poles until the supporting area 8*a* touches the ski (FIG. 3). This movement of the lever 3 from the position according to FIG. 2 over into the one of FIG. 3 causes the pressure area 6*b* of the cam 3*c* which follows the movement to run onto the bail arms 4*b* and to push them downwards against the function of the (relatively weak) spring 5 whereby cam 3*c* passes its dead center position where the cam reaches its greatest height. The position of the various parts is carefully chosen which means that the supporting area 8*a* of the lever 3 prevents the cam 3*c* which is positioned immediately behind its dead center in FIG. 3, from any further movement. In the end position the cam 3*c* almost exerts its biggest turning force onto the bail arms 4*b*, which assures that even in this position the spring 5 cannot push upwards the bail arms 4*b* which prevents any unintended backward movement. The height of the cam, the pivoting angle of the bail and the shape of the bail arms are chosen so that in the locking position of the binding the spread-apart free end portions of the bail arms press down the edge of the boot-sole which means that the boot-toe is securely fixed to the base plate 1.

As can easily be seen a relatively reduced force is necessary to push down the locking lever 3*a* in order to lock the binding. This is due to the great length of the locking arm 3*a* in relation to the height of the cam and to the relatively big distance of the portion of the bail 4 which is touched by the cam 3*c* from the pivoting axis of the bail 4 (which is formed by pin 4*a*). On the other hand cam 3*c* immediately behind the dead center of its pressure area 6*b* exerts a pressure onto the bail arms 4*b* of the bail 4. A small pivoting movement of cam 3*c* caused by a pressure onto the release arm 3*b* (or a lifting of the locking arm 3*a*) is sufficient to move cam 3*c* automatically backwards into its starting position according to FIG. 2 which means that the spring 5 exerts a pressure onto the bail arms 4*b* of the bail 4 and thus the binding is released. As soon as the bail arms 4*b* release their pressure onto the boot-sole the boot can be lifted off the base plate 1 without any further problems because no other parts of the binding are in the way.

Cam 3*c* may include a recess in the area of the longitudinal central axis of the binding so that there are two cams protruding downwardly one above each of the bail arms 4*a*.

It has proved to be of particular advantage to produce the lever, the cam and (if existing) the release arm in one piece preferably of plastic.

The bail is preferably made of steel wire. It would, however, be possible to use a leaf-shaped bail which could, for example, be produced out of a steel sheet.

The described ski binding is not only simple in its construction and production but also simple with respect to its handling, it requires a small amount of force and enables carefree inserting and releasing of the boot.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Binding for cross-country skiing comprising:

a base plate with side plates;

a bail pivotally mounted on said base plate, said bail being adapted to lock a boot-toe temporarily to the base plate;

a lever being pivotally mounted on an axis lying above the bail;

said lever including a cam protruding downwards which exerts a pressure onto said bail at a certain distance behind the pivotal mounting of said bail;

said lever cooperating with the bail so that after pivoting the lever upwards into a first position the bail is released and after pivoting the lever downwardly, passing a dead center, a second position of the lever is reached which pushes down the bail and thus locks the binding; and said cam including a stopping plane which touches the bail with said lever in its first position and a substantially cylindrical pressure area which forms the bottom of said cam and touches the bail at least in said second position of said lever.

2. Binding for cross-country skiing according to claim 1, wherein the cam together with the lever is made in one piece.

3. Binding for cross-country skiing according to claim 2, wherein the cam and also the lever are made of plastic.

4. Binding for cross-country skiing according to claim 1, wherein the lever is pivotally mounted in two bearing brackets on either side of the base plate and higher than the bail.

5. Binding for cross-country skiing according to claim 1, wherein the bail is made of a curved arm-shaped steel wire.

6. Binding for cross-country skiing according to claim 1, wherein said bail is pivotally mounted in a direction transverse to a longitudinal direction of a ski and in a plane parallel to said base plate.

7. Binding for cross-country skiing comprising:

a base plate with side plates;

a bail pivotally mounted on said base plate, said bail being adapted to lock a boot-toe temporarily to the base plate;

a lever being pivotally mounted on an axis lying above the bail;

said lever including a cam protruding downwards which exerts a pressure onto said bail at a certain distance behind the pivotal mounting of said bail;

said lever cooperating with the bail so that after pivoting the lever upwards into a first position the bail is released and after pivoting the lever downwardly, passing a dead center, a second position of the lever is reached which pushes down the bail and thus locks the binding; and said lever including a release arm which extends rearwards from the pivoting axis and is shorter than a locking arm of the lever which extends forwards from the pivoting axis.

8. Binding for cross-country skiing according to claim 7, wherein the free ends of the locking arm, of the lever as well as of the release arm have a recess on the upper surface of the lever which facilitates the inserting of the tip of the ski-pole.

9. Binding for cross-country skiing according to claim 7, wherein the locking arm of the lever has at its lower side a supporting area forming a downwardly protruding part of the lever which is adapted to engage a top portion of a ski to limit the locking movement.

10. Binding for cross-country skiing according to claim 7, wherein the release arm of the lever has a stopping area on the rearward part of the lever which is adapted to engage a top portion of a ski to limit the releasing movement.

11. Binding for cross-country skiing according to claim 7, wherein said bail is pivotally mounted in a direction transverse to a longitudinal direction of a ski and in a plane parallel to said base plate.

12. Binding for cross-country skiing comprising:

a base plate with side plates;

a bail pivotally mounted on said base plate, said bail being adapted to lock a boot-toe temporarily to the base plate;

a lever being pivotally mounted on an axis lying above the bail;

said lever including a cam protruding downwards which exerts a pressure onto said bail at a certain distance behind the pivotal mounting of said bail;

said lever cooperating with the bail so that after pivoting the lever upwards into a first position the bail is released and after pivoting the lever downwardly, passing a dead center, a second position of the lever is reached which pushes down the bail and thus locks the binding;

said lever including a release arm which extends rearwards from the pivoting axis and is shorter than a locking arm of the lever which extends forwards from the pivoting axis; and said release arm of the lever including a stopping area adapted to engage a top portion of a ski to limit the releasing movement.

13. Binding for cross-country skiing according to claim 12, wherein said bail is pivotally mounted in a direction transverse to a longitudinal direction of a ski and in a plane parallel to said base plate.

* * * * *